US005839976A

United States Patent [19]

Darr

[11] Patent Number: 5,839,976

[45] Date of Patent: Nov. 24, 1998

[54] GAME MAT APPARATUS

[76] Inventor: Elsie A. Darr, 2511 Lakin Ave., Great Bend, Kans. 67530

[21] Appl. No.: 731,065

[22] Filed: Oct. 9, 1996

[51] Int. Cl.[6] ..... A63B 67/00

[52] U.S. Cl. ..... 473/414; 273/237; 273/286

[58] Field of Search ..... 473/414, 4.131, 473/480; 273/238, 237, 286

[56] References Cited

U.S. PATENT DOCUMENTS

| | | | |
|---|---|---|---|
| 3,515,386 | 6/1970 | Gunderson . | |
| 3,927,880 | 12/1975 | Petrusek | 473/141 X |
| 4,017,081 | 4/1977 | Windisch | 273/237 X |
| 4,545,582 | 10/1985 | Andrews | 273/238 |
| 4,848,743 | 7/1989 | Rozek | 473/414 |
| 5,050,883 | 9/1991 | Goldfarb et al. | 273/237 X |
| 5,102,129 | 4/1992 | Roberts . | |
| 5,156,409 | 10/1992 | Barnes . | |
| 5,418,517 | 5/1995 | Matherne et al. | 473/480 X |
| 5,460,381 | 10/1995 | Smith et al. | 273/238 |

FOREIGN PATENT DOCUMENTS

| | | | |
|---|---|---|---|
| 2329207 | 1/1975 | Germany | 473/131 |

*Primary Examiner*—William E. Stoll

[57] ABSTRACT

A firm, flexible game mat has tapered edges, art work, and transparent portions defining sections of sufficient size and spaced to enable a player to place a foot on and hop from one to the jothers. The trasparent portions also provide areas through which images and lights are visible. The apparatus includes an electronic control unit, including a variety of function buttons, a score display screen, and a speaker device, which along with multiple lights and sensors and other electronic componentes located throughout the game mat provide a variety of functions allowing a player to interact on the game mat whereby movements are detected by sensors and activate changes in the electronic control unit, components, and devices for computing players' progress, displaying scores, activating various lights and images, and producing multiple sound and music for entertaining players and to direct the playing of a game. When the actuator button is pressed lights and music are generated. A scotch included with the game is tossed upon the mat lighting a player identification indicator. A player hops from the first block to the last block, turns, and hops back picking up the scotch on the return journey. This process is repeated by each player. Each player's score is displayed on a score display screen. Pressing the reset button clear prior game information in the electronic control. The electronic control unit deactivates after a predetermined period of time if no activity on a game apparatus is sensed or detected.

18 Claims, 4 Drawing Sheets

GAME MAT APPARATUS

BACKGROUND

1. Field of Invention

This invention relates to a game apparatus, and more specifically to an improved form of a game apparatus wherein an electronic device is used to provide various lights and sounds for entertainment and direction of the game provided on the surface of the game mat.

2. Background Description of Prior Art

Games and learning devices arc more fun and more effective when they are both easy to use and have features that engage the attention of the user. Hopscotch game apparatus requiring multiple pieces and complexity of involvement for arrangement of a game has been used in the past. Such games have taken a variety of forms. For example, a prior art device utilizing a hopscotch court is set forth in U.S. Pat No. 3,515,385 to Gunderson wherein a hopscotch court comprising of multiple pieces are provided whereby variations in a hopscotch pattern and hopscotch games are possible.

U.S. Pat. No. 5,156,409 to Barnes wherein a game is formed with a multiple of playing pieces that may be loosely arranged in various patterns to form a hopscotch game and a multiple of playing pieces to add and remove for the purpose of varying the game and includes a plurality of cards which are used for indicating the direction of the game.

U.S. Pat. No. 5,102,129 to Roberts wherein a game discloses multiple pieces for the purpose of interconnecting in various positions and adhere to an underlayment forming a variety of hopscotch diagrams, and a plurality of markers are provided for the purpose of identifying a player.

Other, more simple games and amusement devices have been used in a game apparatus in a variety of different forms. For example, as offered commercially in local retail stores such as Wal-Mart (et al.), carpets and rugs produced by Natco, Liberty, and Wal-Mart, made in Belgium and China, having hopscotch and various other games and designs printed on their surface.

The disadvantages of the prior art are that the multiple pieces require assembly and generates volume presenting some inconvenience in transporting, preparation, and playing of a game. Still others having fiber surface and foam backing have an inherent tendency to bunch and curl, collect dirt, and offer a degree of difficulty in cleaning. The prior art apparatus offers variety and suitable appearance, however, a safer more convenient apparatus is possible.

In consideration of the various prior art apparatus, it becomes apparent that there continues to be a need for a new and improved game apparatus as set forth by the electronic invention which addresses the problems of ease of use and cleaning as well as effectiveness in construction in providing a hopscotch game that is engaging and provides entertainment and fun and in this regard, this invention fulfills this need.

None of these known apparatus provide an electronic game mat that uses an electronic device having capability for providing lights and sounds for entertaining and to guide or direct the playing of the game.

SUMMARY OF THE INVENTION

Accordingly, my invention is directed toward providing a game apparatus having an appealing appearance in which an electronic device provides visual and audio entertainment such that increases the interest level and aids in the promotion of physical exercise and motor skills. For example, the game mat apparatus provides a game board such as that for hopping on and featuring attractive graphics and art work. Pushing the actuating button of an electronic device triggers an electronic circuit that causes each block of a diagram to light and illuminates in a steady pattern and, simultaneously, a multiple group of lights are selected and have multiple variations of patterns for a short period of time causing a visual display on the surface of the game mat, and a variety of sounds are generated during this time period.

A series of player selector buttons are pressed, and a playing piece is tossed upon a game board, each toss, in turn, triggers a player identification indicator corresponding to each player selector button, to light in a steady pattern and remain on for the time period of a game for the purpose of claiming a block, while other lights having different predetermined patterns and time periods may light intermittently throughout the course of a game. During this time period, different sounds are generated by the electronic device.

Predetermined lights and sounds correspond to particular movements through a number of spaces along the path of a game board, for example, a different group of lights and sounds are activated for a block, a line of a diagram, and an outer area of a diagram, or a claimed block, corresponding to each move through a turn, and the number of correct and incorrect moves of each player are counted, recorded, and displayed by the electronic device and a player having the highest score is rewarded with a multiple number of lights and sounds. The electronic control unit interactively directs through lights and sounds the playing of the game, and thus makes the game more interesting to play by relaying the required instruction to the player. The game board-mat configuration of the invention also provides an attractive appearance thereby increasing its use as a decorative piece in a child's room.

DETAILED DESCRIPTION

Figure 1:
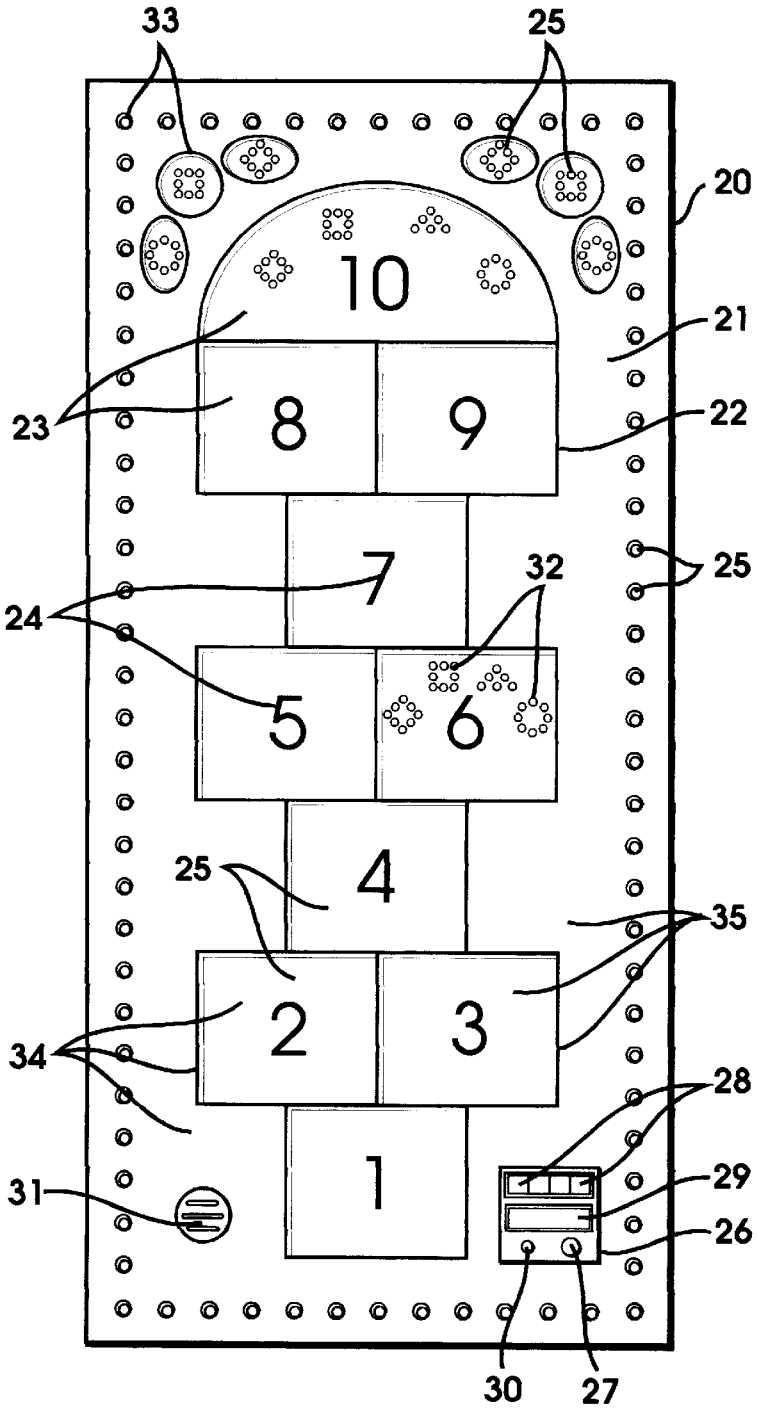
FIG. 1 is a schematic top view of an electronic game mat constructed according to the principles of the invention, illustrating the Hopscotch game format of the invention.

An electronic hopscotch game mat 1 of the invention is seen in a schematic top view in FIG. 1. The game mat has a bottom layer 20 which is connected to a top layer 21 by means of adhesive or other affixing means. The top layer 21 displays a diagram 22 on its surface forming a hopscotch game board as known in the prior art. A diagram 22 has a block 23 which are divided sections within the diagram and a image 24, or digits, are sequentially displayed on each block, or house. A series of lights 25 are positioned around the perimeter of the surface of the game mat and may also be positioned in various other locations on the surface of the game mat 1. Windows 33 are openings being of various shapes and sizes and positioned in various locations on the surface of the mat.

Figures 2, 3:
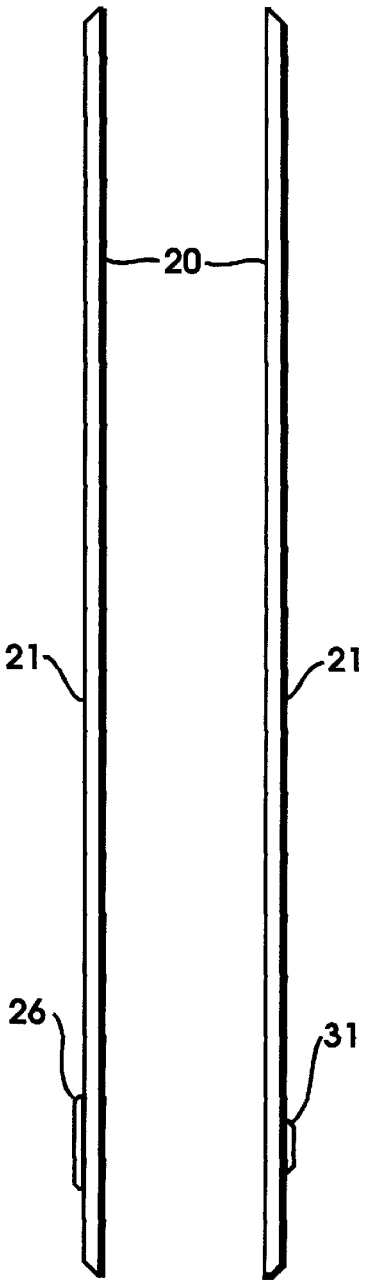
FIG. 2 is a schematic right side view of the game mat of FIG. 1 in an upright position illustrating an electronic control unit.
FIG. 3 is a schematic left side view of the game mat of FIG. 1 in an upright position illustrating a speaker device.
Figure 4:
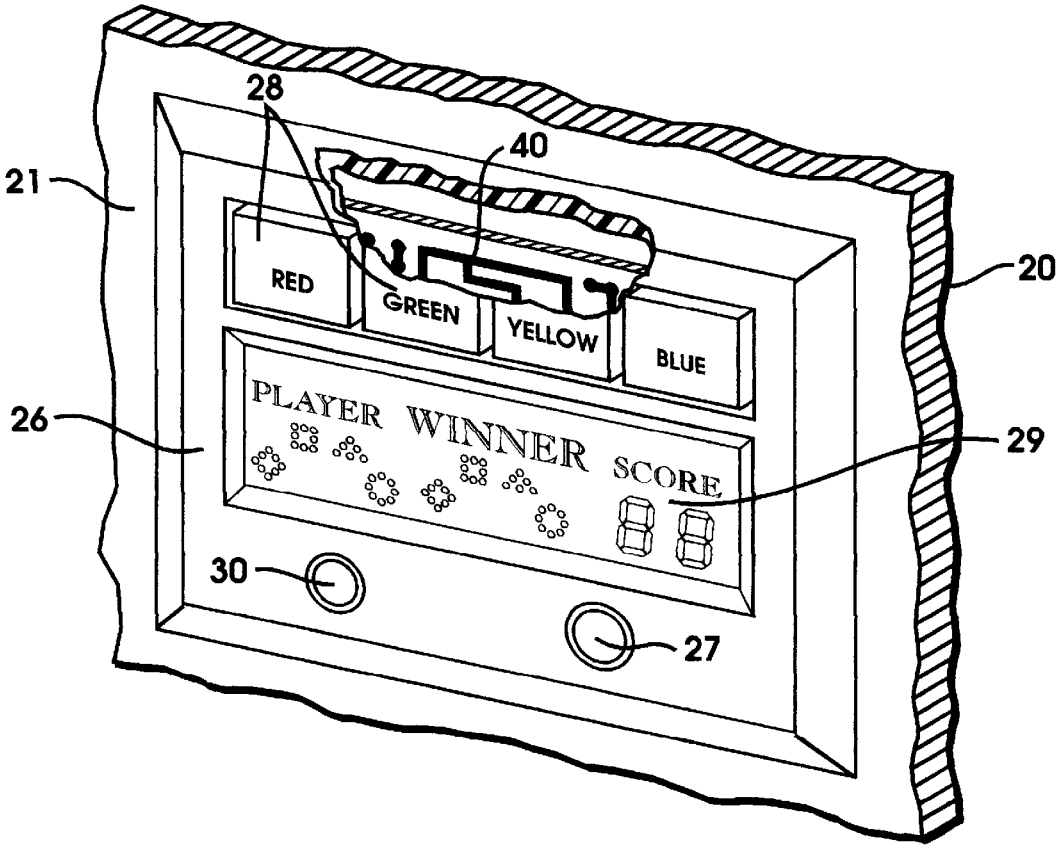
FIG. 4 is a schematic top view of the electronic control unit of the invention with its front cover removed.
Figure 5:
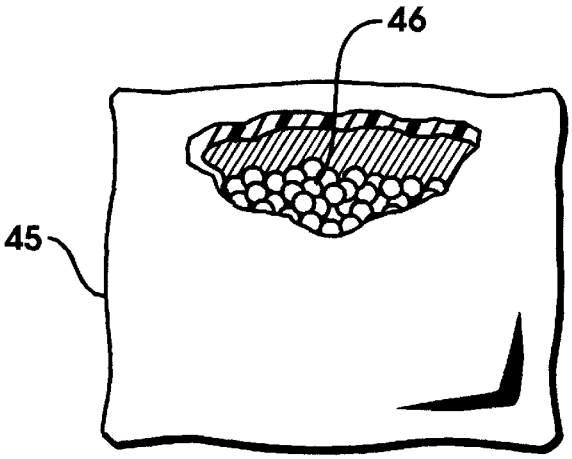
FIG. 5 is a top view of a Scotch, or beanbag, constructed according to the principles of the invention illustrating its shape.
Figure 6:
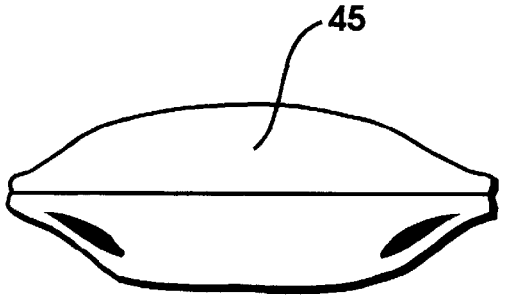
FIG. 6 is a side view of a Scotch, or beanbag, constructed according to the principles of the invention illustrating its shape.

An electronic control unit 26 having an integrated circuit 40, or circuits, and various other electronic components, as well-known in the electronics art, as shown in FIG. 4 is used for control. Included in the electronic control unit 26 is a scoring device having a display screen 29 being of conventional construction that is also well-known the electronics art. An electronic control unit 26 is enclosed in a box-like housing made of plastic or other suitable material, along with a speaker device 31 also well-known in the art of electronics, and are mounted by adhesive or other affixing means to the bottom layer 20 and may slightly protrude through an opening in the top layer 21 as shown in FIG. 1, 2, and 3. A Scotch 45, or beanbag, is a playing piece of the hopscotch game mat 1 having a pillow-like shape and a pliable outer covering as shown in FIG. 5–6. A beanbag 45 may be filled with sand or other suitable material and contains and element for detection by sensors located in a game mat of FIG. 1.

An electronic control unit 26 has on its face an actuator button 27. When the button 27 is pressed, an integrated circuit(s) 40 having components for counting and logic abilities, or other suitable electronic components or abilities, is triggered and the lights 25 sequentially flash in a "chaser" motion or may have a steady or random pattern, and may remain lit for the duration of a game.

A block 23 and a windows 33, or openings, of the game mat 1 are made of transparent, clear or color tinted, vinyl or other suitable material, and serve as "windows" that lights and other features, such as lighted or non-lighted shapes or images, or other suitable features of the game mat may be seen through. Blocks may also be made of solid colored or opaque material having small windows or openings through which lights or other features may be seen. A block 23 has under its surface light emitting devices well-known in the electronics art that simultaneously light up each of a block 23, and remains lit for the duration of a game when an actuator button 27 is pressed.

An image 24 being a light emitting device, or a series of light emitting devices, also known in the electronics art may also simultaneously light and remain lit during the course of a game when the actuator button 27 is pressed. An image 24 may be made of a fiber-type material having the ability to carry and emit light through its length by means of connection to a suitable light emitting source as is well-known in the fiber optics art. An image 24 may also be made of a "glow-type" or reflective material or other suitable material, or may be printed, or other various methods known in the art.

Design shapes 34 being a multiple number, or group, of LED's or other suitable miniature lights, known in the electronics art, light in a steady pattern and may remain lit during the course of a game and may have a steady, random, or intermittent on and off pattern. Design shapes may be numerous groups having a variety of shapes, or may be a variety of non-lighted design shapes, or may be made of reflective or other suitable materials.

Blocks 23 have under their surface sensors, and or switches, or element sensing devices, or other suitable sensing devices, and may have a rubber spring-type "boot" covering, or other suitable material or device, encasing sensing devices to protect sensors from damage. Blocks 23 also have under their surface player identification indicators 32 which are lights, or lighted shapes or symbols, and each corresponds in color to a player selector button 28, that when activated, light and remain lit for the duration of a game. As well-known in the art, music and other sound effects also may be generated by an integrated circuit(s) 40 at predetermined times while the game is in progress and are audible through a speaker device 31 as well-known in the art.

An electronic control unit 26 contained in the game mat 1 is activated by an actuator button 27 and displays on its face a score display screen 29 and indicates the number of players and each player's progress during the course of a game and a player selector button 28 being one of four buttons, each being a different color, and when pressed, sends a signal to an integrated circuit(s) 40 which registers a color-code corresponding to the color of a player selector button pressed, along with the number of players in the order of sequence in which the buttons were pressed.

An electronic control unit 26 keeps track of, records, and displays a score on a display screen 29 of each players progress during the course of a game. An electronic control unit 26 has on its face a reset button 30 when pressed, clears information and the score of a previous game from an electronic control unit 26 and a score display screen 29 and is reset for a new game.

A Scotch 45 is made of a soft, thin layer of vinyl, or other suitable material, formed in a square, or pillow-like case and filled with sand or other suitable material being of a small size to fit comfortably in the hand and of suitable weight for tossing and may contain an electronic element for the purpose of being detected by an element sensing device located in the game mat 1 which will be discussed subsequently.

A Scotch 45 as shown in front view in FIG. 5 and a side view in FIG. 6 is a game piece of the game mat 1 and is used for the purpose of tossing on the hopscotch game mat in an effort to land on a block 24, or house, for the purpose of "claiming" a house on which the beanbag lands as a player's house on which another player is not allowed to step on, jump on, or touch during the course of a game. A player tossing the beanbag, or Scotch, may step on, jump on, or touch, his or her, house only on the return journey of that players turn, whereupon, a player picks up his, or her, Scotch.

A Scotch 45 when landing on a block 23 activates an element, pressure, or other suitable sensing device, located under the surface of a block on which it lands and triggers an electronic control unit 26 which simultaneously activates a player identification indicator 32 being one of series, or group, of lights, or other suitable indicator, each being a different color and corresponding to the color of its perspective player selector button 28, identifying a player by the order of sequence in which the player selector buttons were pressed. A player identification indicator 32 when activated, lights and remains lit for the duration of a game.

An electronic control unit 26 receives signals from sensors located under each block 23, the lines of a diagram 22, and the outer area of a diagram 22, and counts and keeps track of each movement detected during the course of a turn and logically determines the start and finish of a turn, and a game. Signals are sent to, and recorded in, a scoring device and the results are displayed on a score display screen 29. A movement on a line of the diagram 22, or outer area of the diagram, or a block 23 having been claimed, or "claimed house", is detected as an error in the electronic control unit 26, and sounds are generated to alert players of an error and may be accompanied by flashing lights or other suitable displays of lights. These functions are repeated during the course of each player's turn. An electronic control unit 26 deactivates after a predetermined period of time if no activity is detected by sensing devices.

The electronic control unit 26 and integrated circuit(s) 40 that accomplishes the above described functions is of conventional construction that is well-known in the electronics art and forms no part of the present invention. For example, an electronic device having integrated circuits, and or, other suitable electronic components that perform these functions are available at Radio Shack and other electronic retail stores along with information enabling consumers to build and operate games having the same functions as described in game mat 1 of the invention, as shown schematically in FIG. 4. Some functions performed may not be available through retail stores, but may instead incorporate the technologies of chip design available through commercial companies specializing in electronics, specifically, integrated circuits (IC) and chip design, as well-known in the art.

The electronic control unit 26 is linked by connecting wires or leads, or other suitable electronic components, to operate the various components contained in, and throughout, the game mat. A standard, conventional battery or other power supply (not separately shown) is also provided. The electronic control unit 26, integrated circuit (IC) 40, and other electronic components, wiring, and or, leads, are encased in a housing made of plastic or other suitable material to protect the electronics from exposure or damage. The top layer 21 and a bottom layer 20 of the game mat 1 also serves as a housing for connecting wires, leads, lights, and various other lights or electronic components located throughout the game mat to protect the electronics from exposure or damage and may have other suitable elements, components, or devices to protect the electronics from damage caused by impact or stress incurred by normal use of the game mat.

An actuator button 27 is pressed which triggers the integrated circuit(s) 40 contained in the electronic control unit 26 and signals lights 25 to light in a "chaser" motion and remain lit for the duration of a game. Simultaneously, a block 23 each light and remain lit for the duration of the game along with an image 24, each light and remain lit during the course of a game. An image 24 may glow or illuminate depending on the materials used. Simultaneously, a speaker device 31 is activated by an electronic control unit 26 which generates sounds, and or, music.

Each player presses a player selector button 28 being one of a series of buttons, and each being a different color. A signal is detected in the electronic control unit 26 and a color-code is activated along with the number of a player, in the sequential order in which the player selector buttons 28 were pressed. A Scotch 45, or beanbag, is tossed by a player upon the surface of the diagram 22 of the game mat 1 and lands on a block 23 and activates a sensor or other sensing device located under the surface of the block on which the Scotch lands and a signal is sent to the integrated circuit(s) 40 located in the electronic control unit 26 which returns a signal to one of a series of player identification indicators 32 located under each block 23 corresponding to the color of the player selector button pressed, and the player number by the order of sequence in which the button was pressed. For example, four player selector buttons 28 may be: first button, 1-red, second button, 2-yellow; third button, 3-blue; and the fourth button, 4-green.

A block 23 is activated by a Scotch tossed by the first player when landing on a block; this would be read in the integrated circuit(s) 40 as: 1-red, and a red player identification indicator 32 lights and remains lit for the duration of a game identifying that block as the first player, or player one's, "house". A player hops, or jumps, on each block 23, excluding that player's house, turns around and hops, or jumps, on each block 23, in reverse order, picking up the Scotch and hopping, or jumping, on that player's house on the return journey. The electronic control unit 26 detects, counts, and records the sensing signals of each block 23, error signals detected on a diagram 22, and outer area of a diagram 22, or a "claimed" block, during the course of a players turn, and each player's score is displayed on the score display screen 29. This procedure is repeated by players 2, 3, and 4. Each is assigned their respective player number, and color-code, and player identification indicator 32 located under each block 23 and each corresponding to the color of a player selector button 28.

The object of the game of hopscotch being to hop or jump on each block from the first block to the last, turn, and hop or jump on each block from the last to the first, without touching the line of the diagram 22, another player's house, or the outer area of the diagram, and if successful, a player is rewarded with music, and or, sounds along with a multiple combination of lights, having a variety of patterns and in a variety of locations on the game mat, light for a short predetermined time period. A player hopping or jumping on line of the diagram 22, another player's house, or the outer area of the diagram is detected by sensors located under the surface of the game mat 1 and a player is alerted by an alarm sound(s) generated by the electronic control unit 26 through a speaker device 31 and is simultaneously recorded in an electronic scoring device and is reflected in a players score which is displayed on a score display screen 29.

The game of hopscotch becomes progressively more difficult with each round as each player claims more houses on each turn as in the prior art. The winner is the player having the highest score for successful jumps, or the highest score after a number of failed attempts, equalling the number of players, and is detected in the electronic control unit 26. A player having the winning score is rewarded at the end of a game with the winning player's player identification indicator 32 flashing or blinking and a display of various lights and sounds being different than the first are activated. A block 23 located at the far end of the mat, being the highest house, may also flash or blink, and or, various lights within the block may flash or blink for a short, predetermined period of time. Other blocks 23, or lights within the blocks, may also light, flash, or blink. Design shapes 34 being comprised of lights, or other suitable material, may light and remain lit, flash, or blink either randomly or at predetermined times during the course of a game and may be seen through a window 33. Design shapes may reflect a player's identification indicator 32. Music, and or, sounds may also be simultaneously generated for a short, predetermined period of time. A game may be stopped at any time by pressing a reset button 30 which clears all the information, instructions, and scores gathered in an electronic control unit 26, and displayed on a score display screen 29 prior to pressing a reset button 30 and mat is readied for a new game.

Figure 7:
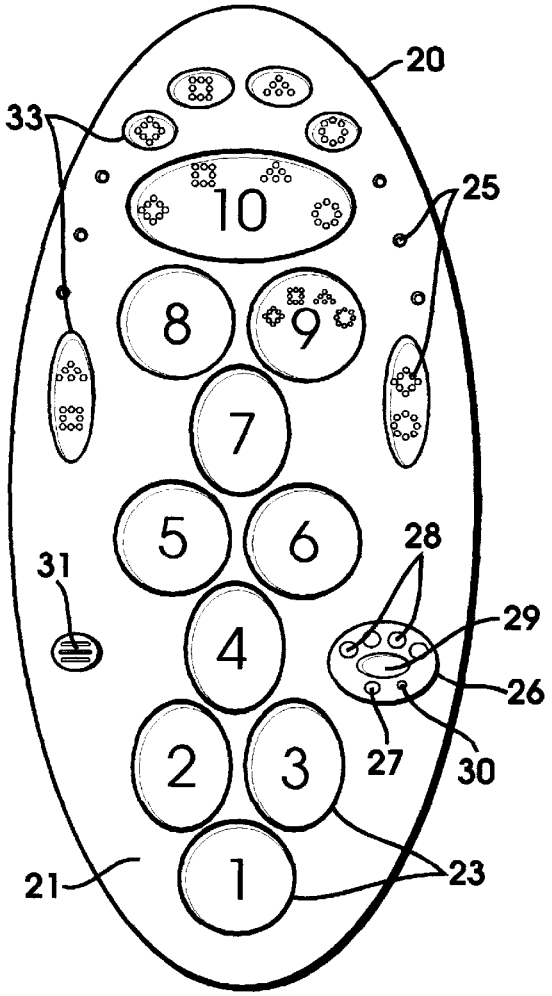
FIG. 7 is another embodiment of the game mat 1 illustrating an oval form of the game mat. An oval, or round, electronic control unit, actuator button, player selector buttons, a reset button, a score display screen, and a speaker device, and variations of an opening, or window, a block, a design shape, and a group of lights.

Other possible embodiments of the game mat are shown in FIG. 7–10 and may be incorporated into the game mat 1 and shown in FIG. 1–3. FIG. 1–3 illustrates a square or rectangular electronic control unit, score display screen, player selector buttons, and a speaker device, a round actuator button, and reset button arranged on the surface of the mat. Of course these objects or devices may be of numerous other configurations, such as circular, semi-circular, oval, or irregularly shaped. An example of the game mat employing an oval shape is shown in FIG. 7. The hopscotch game mat of FIG. 7 shows an electronic game mat having an electronic control unit 26, an actuator button 27, player selector buttons 28, a reset button 30, and a speaker device 31 having an oval shape, and a variation of lights 25, windows 33, and design shapes 34. The electronic control unit 26 and game mat has all the components and devices as shown in FIG. 1–3 and functions in the same manner as in the game mat of the invention.

Figure 8:
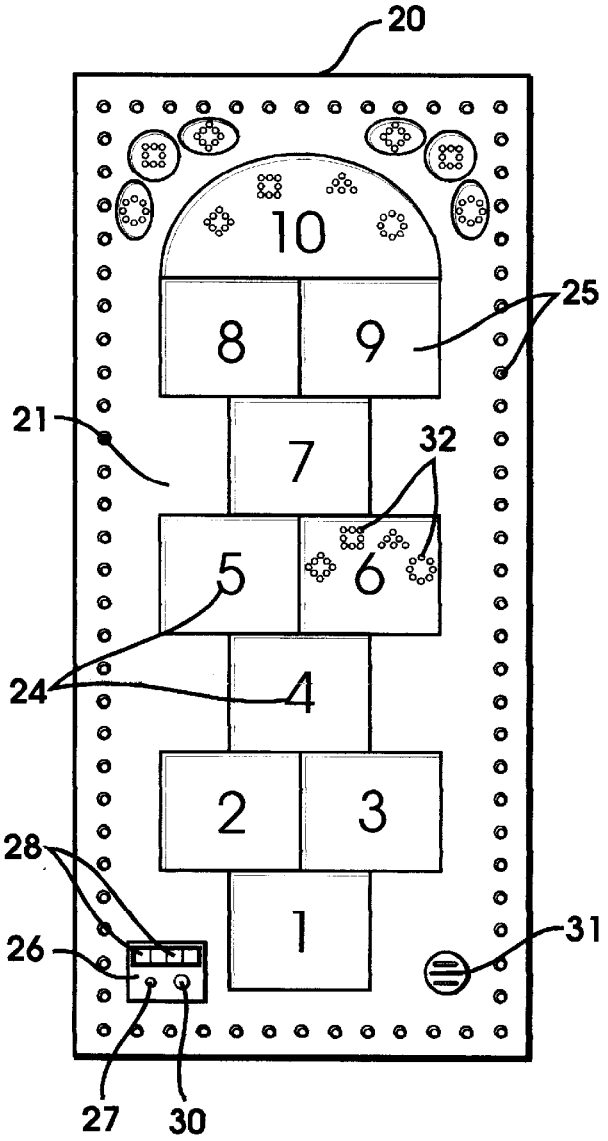
FIG. 8 is an embodiment of the game mat 1 illustrating a rectangular, or square, electronic control unit and player selector buttons. An oval or round actuator button, reset button, and speaker device.

FIG. 8 shows a game mat having and electronic control unit 26, an actuator button 27, player selector buttons 28, and a reset button 30. The actuator button 27 is pressed and lights and sounds are activated as in the game mat of FIG. 1–3. Players press a player selector button 28, in turn. A Scotch is tossed upon a block of the game mat and a player identification indicator is activated and sounds or music are generated. Or, if a Scotch lands on a claimed block, a line of a diagram, or outer area of a diagram, a light, or group of lights, are activated and an error sound is generated. A variety of lights and sound are activated during the course of a game triggered by sensing devices and predetermined by changes in an electronic device and a player is directed down the path of the game, and back, and a winner is known by a series of sounds and lights. When restarting a game, a reset button 30 may be pressed to clear the information obtained in a prior game in order for all of the functions of the game to perform correctly and keep track of a game and each player's performance.

Figure 9:
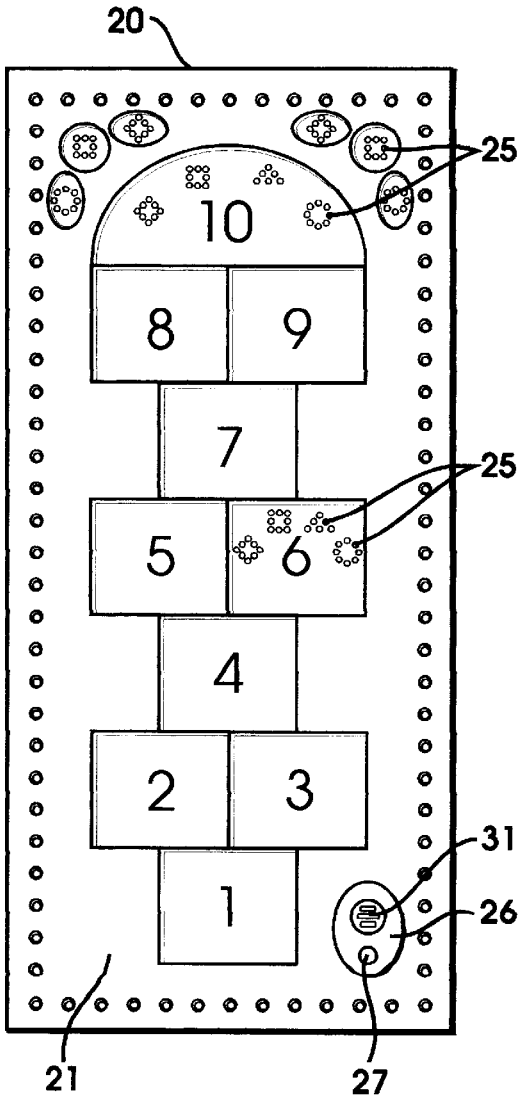
FIG. 9 is an embodiment of the game mat 1 illustrating a rectangular game mat having an oval or round electronic control unit, actuator button, and speaker device, and variations in lighted design shapes.

FIG. 9 shows another embodiment of the game mat 1 having an electronic control unit 26, an actuator button 27, and a speaker device 31, having an oval or round shape. Pressing the actuator button 27 activates lights 25 and 34 which may alternate or simultaneously function in a variation of predetermined patterns, and a block and an image each light and remain lit in a steady pattern. Sounds, and music are generated intermittently and are predetermined in the electronic control unit 26.

Figure 10:
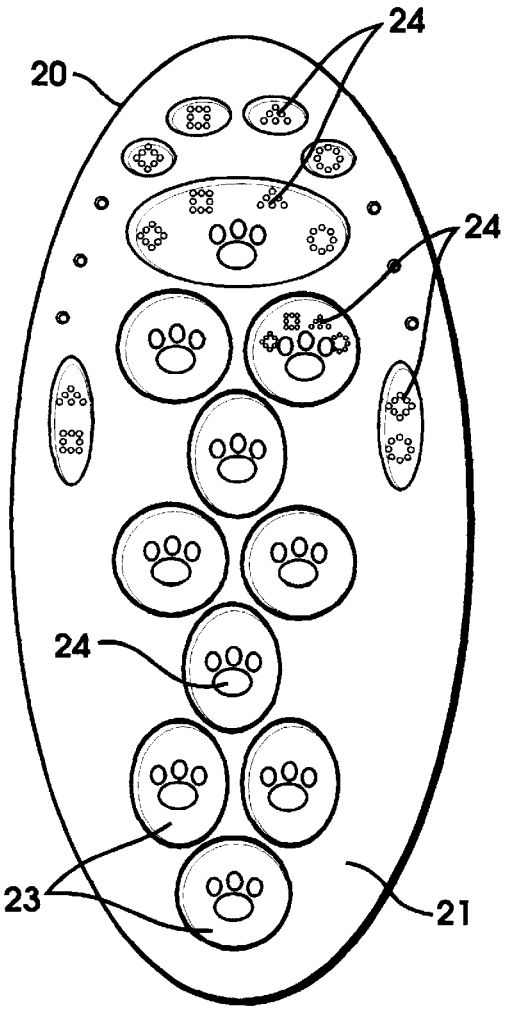
FIG. 10 is an embodiment of the game mat 1 illustrating a non-electronic game mat having variations and locations of non-lighted design shapes.

FIG. 10 shows a non-electronic embodiment of the game mat 1 in which a block 23 has an oval or round shape, and a design shape 34 is made of reflective or glow type, or other suitable material, and an image 24 being paw prints, or various other suitable image.

The game mat of FIGS. 7–9 as in the game mat of FIG. 1 include activity sensing devices which automatically deactivates the electronic control unit after a predetermined period of time if no activity is detected.

The game mat of FIGS. 9 and 10 include an erasable marker, removable patch, or other suitable devices, provided for the purpose of identifying and claiming a block as a player's house. A marker may be plural in number and be a variety of colors. Patches, or other suitable devices, may be multiple in number and may have various shapes, colors, and size, and may be made of a thin plastic or other suitable material having the properties of holding, or sticking to the surface of the mat by means of static electricity, magnetic force, or other suitable method or means. FIGS. 9 and 10 may contain magnetic elements or other suitable devices for the purpose of holding, sticking, or attracting removable patches. A Scotch 45 as shown in FIG. 5–6 are also provided with the game mat of FIG. 7–10. The game is played in all embodiments of FIGS. 1–3 and 7–10 as in the prior art of hopscotch.

Thus the reader will see that the game mat of the invention provides a game mat that has an attractive appearance and is designed to excite the senses and provides many hours of fun and entertainment. A game mat that offers ease of use and cleaning and is safer to use, and may be used by children of many ages and therefore parents and teachers will find it to be a valuable aid in entertaining children confined indoors, and in promoting social and motor skills, and physical activity. The game mat may be used as a decorative piece in a child's room and is easy to transport and store.

While my above description contains many specifications, these should not be construed as limitations on the scope of the invention, but rather as an exemplification of one preferred embodiment thereof. Many other variations are possible. For example, the mat may have other shapes, such as, circular, oval, square, etc., and have a variety of colors; the surface of the mat may be smooth having transparent portions through which windows, or openings, may be visible; the diagram may have other shapes such as those above depending on the shape of the mat that it is used on, or preference, and only limited by the imagination; the lights, windows, and player identification indicators, may have a variety of other shapes, sizes, and colors.

The electronic control unit, actuating button, electronic score display screen, player selector buttons, and a speaker device may have other shapes such as those mentioned above. These devices may have other thicknesses and may have other suitable encasements and may be embedded in the mat having their positions known by art work, or other suitable method, which are visible on the surface. These devices may be arranged in any number of combinations, and may be located in various positions on the game mat. Player selector buttons and corresponding player identification indicators may vary in number.

Blocks may vary in number and have different shapes, sizes and positions. A block may have a variety of images, such as footprints, critters, or other suitable shapes or designs, displayed in, or on them, by a variety of suitable methods and may be accompanied by a number, and may be lighted or non-lighted images made of suitable material.

The game mat may have other games displayed on its surface by any number of suitable methods, or may have a variation of specific areas that light changing the shape or outline offering variations of a hopscotch game, or may provide a game design for other games different from hopscotch, or may have other gadgets, devices, or other suitable components, incorporated onto its surface and included with a game. A game mat having the abilities of a changeable gameboard would include on its surface a game selector unit, or buttons included on an electronic control unit, or other suitable location, for the purpose of selecting and displaying a variation of the hopscotch game, or any number of different games.

The game mat may be constructed of one layer of vinyl or other suitable material having all of its elements, components, or devices embedded in its layer through a process of the material being liquid, or other suitable process, during its fabrication or manufacture.

The electronic control unit may have other variations of lights, sounds, and music; and other timer, counting, and logic abilities, or other suitable means, making it useful or other games, or may have means for selecting a variety of games on one game mat.

Accordingly, the scope of the invention should be determined not by the embodiment(s) illustrated, but by the appended claims and their legal equivalents.

What is claimed is:

1. An electronic game apparatus comprising;

Two layers of flexible, moisture resistant material affixed together forming a mat, said mat having a tapered edge and being of sufficient thickness as to lie flat, said mat comprising an upper surface having graphics and art work forming a game playing pattern;

a plurality of lights on the surface of the mat including at least some of said lights located around the surface of the mat;

an electronic control unit for selecting and performing different game functions secured to the mat, said electronic control unit including means for selectively operating and changing said lights for predetermined periods of time in response to different functions selected and performed by the electronic control unit, and an actuator button for causing the control unit to selectively operate said lights to indicate the game mat is activated;

said electronic control unit including a sound generating means for generating sounds and music in response to the different functions selected and performed by the electronic control unit;

said electronic control unit including means for input, analyzing, and reporting information received in the electronic control unit in response to different functions selected and performed by the electronic control unit; and said electronic control unit including means for indicating players and player's scores in response to different functions selected and performed by the electronic control unit.

2. The game mat of claim 1 wherein said plurality of lights are single lights or groups of lights, and said means for selectively operating and changing said lights comprises an electronic circuit.

3. The game mat of claim 2 wherein said electronic circuit includes a switch operable in response to activation of said actuator button to turn the lights located around the surface of the mat on and off in sequence, thereby producing a chaser motion around the surface of said mat, and simultaneously turn on other of said lights to light in a steady pattern, flash, blink, or have a random pattern of illumination, each for a predetermined time period thereby providing a visual display.

4. The game mat of claim 2 wherein said electronic circuit includes a sound generating device for generating multiple sounds including sounds in response to operation of said actuation button.

5. The game mat of claim 4 wherein said sound generating device for generating multiple sounds includes a speaker secured to a surface of the mat whereby the sounds are audible.

6. The game mat of claim 4 wherein said game playing pattern is divided into blocks defined by edges, each block being of such size as to enable the players to place a foot on the block within the edges, said mat includes force sensors for producing signals located under said upper surface and positioned to detect and distinguish between movement on each of said blocks, the edges of each block, and the area of said mat outside the blocks, and said sound generating device for generating multiple sounds generates sound in response to detection of movement on an edge of a block by a sensor positioned to detect movement on that edge or in response to detection of movement on the area outside the blocks by a sensor positioned to detect movement on that area.

7. The game mat of claim 6 wherein said electronic circuit includes an attempt detection means to detect and count signals from said movement sensors.

8. The game mat of claim 2 wherein said electronic circuit includes an electronic mechanism operable in response to functions of said electronic control unit for input, analyzing, and reporting information received in said electronic circuit.

9. The game mat of claim 1 wherein said game playing pattern is divided into blocks defined by edges, each block being of such size as to enable the players to place a foot on the block within the edges, the material of the mat within each block being of transparent material, and said plurality of lights including lights for illuminating each block and a plurality of lights forming an image, a number, or both, at each block.

10. The game mat of claim 9 wherein each block includes a plurality of player identification indicators, each identification indicator being a group of lights forming a different shape and each being a different color.

11. The game mat of claim 1 wherein said game playing pattern is divided into blocks defined by edges, each block being of such size as to enable the players to place a foot on the block within the edges, and said mat includes element detection sensors for producing signals located under said upper surface and positioned to detect and distinguish between contact on each of said blocks, the edges of each block, and the area of said mat outside the blocks.

12. The game mat of claim 11 wherein said electronic circuit includes an attempt detection means to detect and count signals from said sensor means.

13. The game mat of claim 11 and further including a playing piece or Scotch, said playing piece including an element detectable by said sensor means when said playing object is tossed upon the surface of said mat to trigger said sensor means.

14. The game mat of claim 11 wherein said electronic circuit includes a sound generating device for generating multiple sounds including sounds in response to detection of movement on a block by said sensor means.

15. The game mat of claim 1 wherein said upper surface includes a plurality of openings varying in size and situated in various locations on the surface of said mat forming windows through which lights and images are displayed.

16. The game mat of claim 1 wherein said electronic control unit includes a plurality of player selector buttons each being a different color, and activation of any of said buttons triggers said control unit, and a number, a color code, and a player identification indicator corresponding to each said button is assigned in said control unit.

17. The game mat of claim 1 wherein said electronic circuit includes an electronic mechanism for determining the score of each player and a score display screen for displaying players and player's scores.

18. The game mat of claim 17 wherein said electronic control unit includes a reset button which when pressed causes the electronic circuit to clear information in said electronic mechanism and on said score display screen, and said electronic mechanism is also cleared by predetermined sets of changes in said electronic circuit, and said electronic control unit deactivates after a predetermined time period of no game activity.

* * * * *